US009850592B2

(12) United States Patent
Suh et al.

(10) Patent No.: US 9,850,592 B2
(45) Date of Patent: Dec. 26, 2017

(54) COMPLEX PLATING FILM FORMED USING MULTI-LAYER GRAPHENE-COATED METAL PARTICLES THROUGH ELECTRIC EXPLOSION AND METHOD OF MANUFACTURING THE COMPLEX PLATING FILM

(71) Applicant: RESEARCH & BUSINESS FOUNDATION SUNGKYUNKWAN UNIVERSITY, Suwon-si (KR)

(72) Inventors: Su-Jeong Suh, Suwon-si (KR); Young-Il Song, Suwon-si (KR); Jung-Ho Park, Seoul (KR); Jung-Kab Park, Suwon-si (KR); Tae-Yoo Kim, Suwon-si (KR); Hwa-Jin Son, Suwon-si (KR); Jin-Ha Shin, Siheung-si (KR); Mi-Ri Lee, Suwon-si (KR); Jungwoo Lee, Suwon-si (KR); Changhyoung Lee, Gyeongsan-si (KR); Younglae Cho, Suwon-si (KR); Seung-Bin Baeg, Suwon-si (KR); Byung-Wook Ahn, Suwon-si (KR); Sook-Young Yun, Seongnam-si (KR)

(73) Assignee: Research & Business Foundation Sungkyunkwan University, Suwon-si (KR)

( * ) Notice: Subject to any disclaimer, the term of this patent is extended or adjusted under 35 U.S.C. 154(b) by 174 days.

(21) Appl. No.: 14/804,398

(22) Filed: Jul. 21, 2015

(65) Prior Publication Data

US 2016/0024681 A1 Jan. 28, 2016

(30) Foreign Application Priority Data

Jul. 21, 2014 (KR) ..... 10-2014-0091838

(51) Int. Cl.

| | |
|---|---|
| ***C25D 15/00*** | (2006.01) |
| ***C25D 3/38*** | (2006.01) |
| ***B05B 7/00*** | (2006.01) |
| *C25D 3/54* | (2006.01) |
| *C25D 3/48* | (2006.01) |
| *C25D 3/46* | (2006.01) |
| *C25D 3/20* | (2006.01) |
| *C25D 3/12* | (2006.01) |
| *C25D 3/44* | (2006.01) |

(52) U.S. Cl.

CPC ..... *C25D 15/00* (2013.01); *B05B 7/0006* (2013.01); *C25D 3/38* (2013.01); *C25D 3/12* (2013.01); *C25D 3/20* (2013.01); *C25D 3/44* (2013.01); *C25D 3/46* (2013.01); *C25D 3/48* (2013.01); *C25D 3/54* (2013.01)

(58) Field of Classification Search

CPC . C25D 15/00; C25D 3/38; C25D 3/46; C25D 3/12; C25D 3/54; C25D 3/48; C25D 3/20; B05B 7/0006

USPC ..... 427/122; 428/403; 205/50, 322, 316, 205/320, 323

See application file for complete search history.

(56) References Cited

U.S. PATENT DOCUMENTS

| | | | | |
|---|---|---|---|---|
| 8,748,216 | B2 * | 6/2014 | Guo | H01L 21/02568 257/E31.026 |
| 2011/0081487 | A1 * | 4/2011 | Bollman | C23C 14/562 427/255.21 |
| 2012/0098032 | A1 * | 4/2012 | Guo | H01L 21/02568 257/184 |
| 2012/0100660 | A1 * | 4/2012 | Hagedorn | C25D 5/48 438/63 |
| 2013/0040420 | A1 * | 2/2013 | Bollman | C23C 14/12 438/95 |
| 2014/0227548 | A1 * | 8/2014 | Myrick | C06B 45/30 428/570 |
| 2016/0318099 | A1 * | 11/2016 | Seo | B22F 1/02 |

FOREIGN PATENT DOCUMENTS

| | | | | |
|---|---|---|---|---|
| KR | 10-2010-0032012 A | | 3/2010 | |
| KR | 1020110068647 | * | 6/2011 | B82B 3/00 |
| KR | 10-1335457 B | | 5/2013 | |

* cited by examiner

*Primary Examiner* — Douglas McGinty
(74) *Attorney, Agent, or Firm* — NSIP Law

(57) ABSTRACT

Provided is a method of forming a complex plating film using multi-layer graphene metal particles. The method of forming the plating film may include preparing a powder with a metal particle structure coated with multi-layer graphene, and forming a plating film by adding the powder to a plating solution through electric plating.

15 Claims, 3 Drawing Sheets

COMPLEX PLATING FILM FORMED USING MULTI-LAYER GRAPHENE-COATED METAL PARTICLES THROUGH ELECTRIC EXPLOSION AND METHOD OF MANUFACTURING THE COMPLEX PLATING FILM

CROSS-REFERENCE TO RELATED APPLICATION

This application claims priority to and the benefit of Korean Patent Application No. 10-2014-0091838, filed on Jul. 21, 2014, in the Korean Intellectual Property Office, the disclosure of which is incorporated herein by reference in its entirety for all purposes.

BACKGROUND

1. Field of the Invention

The present invention relates to a complex plating film formed using multi-layer graphene-coated metal particles through electric explosion and a method of manufacturing the complex plate film.

2. Discussion of Related Art

Today, electronic materials are developing to become lighter, thinner, shorter, and smaller. To increase a degree of integration of a diode, a size and a width of a metal interconnection are reduced to several tens of nm. In addition, according to development of patterning techniques for producing metal interconnections, a pattern circuit is formed using a plating film having a thickness of 2 μm or less. However, such reduction in the size and width of a metal interconnection leads to an increase in resistance in the metal interconnection and a decrease in electrical properties. In addition, mechanical properties are degraded, thereby reducing durability in a module, and according to such environmental changes, reliability is degraded and thus errors of operability of the module and diode increase.

Therefore, to solve such a problem, there is an increasing demand to manufacture a complex plating film in which electrical properties are maintained and mechanical properties are improved.

SUMMARY OF THE INVENTION

The present invention is directed to a method of forming a metal film by adding multi-layer graphene-coated metal powder with a particle structure to a plating solution using electric explosion.

The present invention is also directed to a plating film formed by the above-described method and having improved electrical properties.

One aspect of the present invention provides a method of forming a complex plating film, which includes preparing a multi-layer graphene-coated metal powder with a particle structure; and forming a plating film by adding the powder to a plating solution through electric plating.

In one exemplary embodiment, the powder is formed through electric explosion. For example, the method of forming the multi-layer graphene-coated metal powder may include coating a metal wire with a carbon-based material; and performing electric explosion of the metal wire coated with the carbon-based material in a solution or in the air, and the carbon-based material may include graphene or graphite.

In one exemplary embodiment, the metal wire may consist of copper, nickel, aluminum, iron, gold, silver or a mixture thereof.

In one exemplary embodiment, the metal powder coated with a multi-layer graphene-coated film including 1 to 20 carbon atom layers may be prepared through the electric explosion.

In one exemplary embodiment, the coating of the metal wire with the carbon-based material may include synthesizing the graphene on a surface of the metal wire, and transferring the synthesized graphene to the surface of the metal wire. In addition, the solution may include at least one selected from the group consisting of isopropyl alcohol, acetone, ethanol, methanol, carbon compound solvents, glycols including carbon, glycerin, triethanolamine, methylene chloride, deionized water, distilled water, hydrogen peroxide and a metal compound solvent.

The multi-layer graphene-coated metal powder is formed by performing electric explosion of the metal wire in a gas atmosphere including a carbon component in the air, and the gas may be a hydrocarbon gas including at least one selected from the group consisting of methane, ethane, propane, butane, acetylene, cyclopentane and cyclohexane.

In one exemplary embodiment, the plating solution may include at least one selected from the group consisting of anhydrous copper sulfate, sulfuric acid and hydrochloric acid, and may further include an additive. For example, the additive may include at least one selected from the group consisting of an accelerator, a leveling agent and a brightener.

In one exemplary embodiment, the powder may be contained at 1 to 10000 part per million (PPM).

The complex plating film according to an exemplary embodiment of the present invention may include a plating film coated on one surface of a base material and consisting of a first metal, and metal powder dispersed in the plating film and including a powder of a multi-layer graphene-coated second metal.

In one exemplary embodiment, the first metal may consist of copper, nickel, aluminum, iron, gold, silver or a mixture thereof.

In one exemplary embodiment, the plating film may have a thickness of 2 to 50 μm.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF EXEMPLARY EMBODIMENTS

Hereinafter, exemplary embodiments of the present invention will be described in detail. The present invention can be modified and implemented in various forms, and therefore, only specific embodiments will be described in detail. However, the present invention is not limited to specific disclosures, and it should be understood that the present invention includes all modifications, equivalents and alternatives included in the technical idea and scope of the present invention.

The terms "first" and "second" may be used to explain various components, but the components should not be limited by these terms. The terms are used only to distinguish one component from another component. For example, without departing from the scope of the present invention, a first component may be called a second component, and similarly, a second component may be called a first component.

The terms used in the present invention are used only to explain specific examples, not to limit the present invention. Singular expressions include plural referents unless clearly indicated otherwise in the context. The terms "include" and "have" used herein designate the presence of characteristics and components described in the specification, and do not imply that one or more other characteristics or components are not included.

All terms including technical and scientific terms have the same meaning that is generally understood by those skilled in the art unless defined otherwise. General terms, such as terms defined in dictionaries, should be interpreted with meanings according to the context related technology, and should not be interpreted with ideal or excessively formal meanings unless they are clearly defined thus in the present invention.

In the specification, the term "metal" is defined to include metal alloys and metal mixtures in addition to pure metals.

Figure 1:
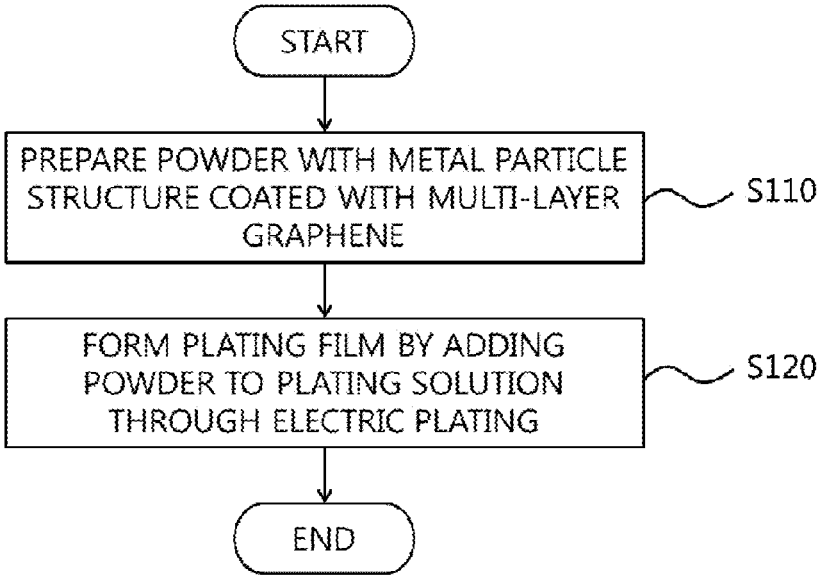
FIG. 1 is a flowchart illustrating a method of forming a complex plating film according to an exemplary embodiment of the present invention.

FIG. 1 is a flowchart illustrating a method of forming a complex plating film according to an exemplary embodiment of the present invention.

Figure 2:
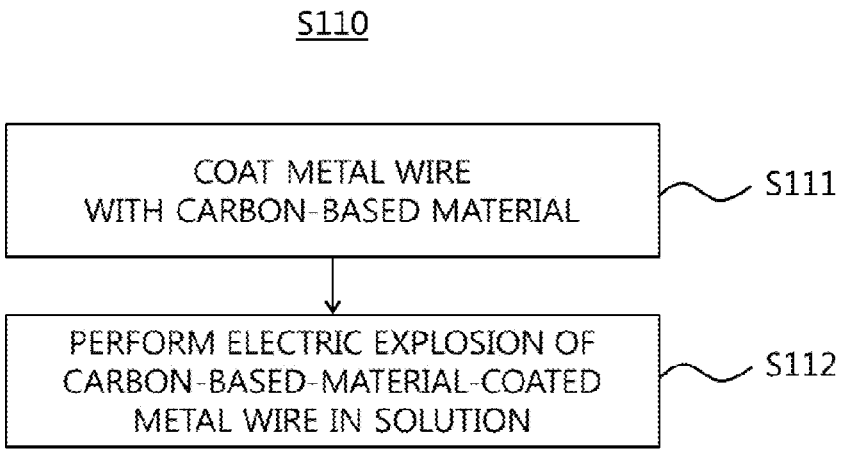
FIG. 2 is a flowchart illustrating preparation of a multi-layer graphene-coated metal powder with a particle structure according to an exemplary embodiment of the present invention.

FIG. 2 is a flowchart illustrating preparation of a multi-layer graphene-coated metal powder with a particle structure according to an exemplary embodiment of the present invention.

Figure 3:
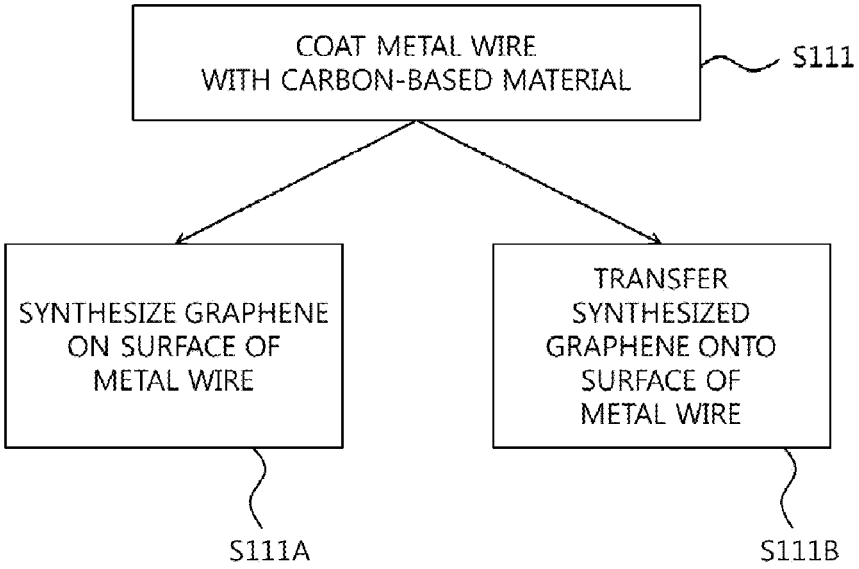
FIG. 3 is a diagram illustrating coating of a metal wire with the carbon-based material according to an exemplary embodiment of the present invention.

FIG. 3 is a diagram illustrating coating of a metal wire with the carbon-based material according to an exemplary embodiment of the present invention.

Referring to FIGS. 1 to 3, the method of forming a complex plating film according to an exemplary embodiment of the present invention includes preparing a multi-layer graphene-coated metal powder with a particle structure (S110), and forming a plating film by adding the powder in a plating solution through electric plating (S120).

The powder is formed through electric explosion. The preparation of the multi-layer graphene-coated metal powder with a particle structure through electric explosion may include coating a metal wire with a carbon-based material (S111), and performing electric explosion of the metal wire coated with the carbon-based material in a solution or in the air (S112), and the carbon-based material may include graphene or graphite.

The metal wire may consist of copper, nickel, aluminum, iron, gold, silver or a mixture thereof. These are examples of electroconductive metals, but the present invention is not limited to the above-described metals.

Through the electric explosion, a metal powder coated with a multi-layer graphene-coated film including 1 to 20 carbon atom layers may be prepared.

The coating of the metal wire with the carbon-based material (S111) may include synthesizing the graphene on a surface of the metal wire (S111*a*); or transferring the synthesized graphene onto the surface of the metal wire (S111*b*).

In one exemplary embodiment of the present invention, the electric explosion of the metal wire may be performed in a solution. In this case, an organic solvent or a water-based solvent may be used as a solvent in the solution. For example, the solvent may include at least one selected from the group consisting of isopropyl alcohol, acetone, ethanol, methanol, carbon compound solvents, glycols including carbon, glycerin, triethanolamine, methylene chloride, deionized water, distilled water, hydrogen peroxide and a metal compound solvent.

The electric explosion occurs when a high voltage stored in a capacitor, for example, alternating and direct voltages of approximately 200 V to 50 kV, is discharged to the metal wire, and the exploded metal wire transitions into a plasma state, and is rapidly cooled and condensed by impact with the solution, thereby forming a metal powder. In such a process of forming the metal powder from the metal wire by the electric explosion, metal atoms of the metal wire may be rapidly cooled in a solution and agglomerated in a stable sphere shape, and carbon atoms of the carbon-based material coated layer may recombine on a surface of the metal powder after the explosion, thereby forming the multi-layer graphene film. Particularly, when the electric explosion occurs in an inorganic solvent, carbon atoms of the organic solvent may also recombine on the surface of the metal powder along with the carbon atoms of the carbon-based material coating layer after the bond between molecules is broken, thereby forming the multi-layer graphene film.

In another exemplary embodiment of the present invention, the electric explosion of the metal wire may be performed in the air. For example, the electric explosion of the metal wire may be performed in a gas atmosphere containing carbon. For example, the gas may be a hydrocarbon gas containing at least one selected from the group consisting of methane, ethane, propane, butane, acetylene, cyclopentane and cyclohexane. Since the hydrocarbon gas includes carbon, a carbon component generated by decomposition of the hydrocarbon gas in the electric explosion of the metal wire may effectively form a multi-layer graphene coating layer on the metal powder prepared together with the carbon component generated by the decomposition of the carbon-based material coating the metal wire. As the hydrocarbon gas, any gas which includes carbon and can bring about the same effect may be used without limitation in addition to methane, ethane, propane, butane, acetylene, cyclopentane and cyclohexane described above.

The plating solution may include at least one selected from the group consisting of anhydrous copper sulfate, sulfuric acid and hydrochloric acid, and may further include an additive. For example, the additive may include at least one selected from the group consisting of an accelerator, a leveling agent and a brightener. For example, the plating solution may include all of anhydrous copper sulfate, sulfuric acid, hydrochloric acid, an accelerator, a leveling agent and a brightener.

The powder may be included in the plating solution at approximately 1 to 10000 PPM. For example, the powder may be included in the plating solution at approximately 50 to 100 PPM. For example, the powder may be included in the plating solution at approximately 75 PPM.

The complex plating film formed according to the exemplary embodiment of the present invention may include a plating film coated on one surface of the base material and consisting of a first metal, and powder of a multi-layer graphene-coated second metal dispersed in the plating film. The metal of the metal powder may be the same as or different from the metal of the plating film. The metal of the metal powder and the metal of the plating film may each independently consist of copper, nickel, aluminum, iron, gold, silver or a mixture of thereof. The metal is one of the electroconductive metals, but the present invention is not limited to the above-described metals. In addition, a thickness of the plating film may be 2 to 50 μm.

Hereinafter, an example of the present invention will be described. The following example is merely an example of the present invention, and the scope of the present invention is not limited to the following example.

Example

A multi-layer graphene-coated metal powder with a particle structure was prepared through electric explosion. A plating solution was an electrolyte solution consisting of anhydrous copper sulfate, sulfuric acid and hydrochloric acid, and as a plating material, copper was used, and the plating solution further included an additive, for example, an accelerator, a leveling agent or a brightener. As conditions for plating, 1 L of a distilled-water-based plating solution was used, a platinum (Pt) electrode was used as a positive electrode, and a plating area was 5 cm×5 cm. For electric plating, a current density was set to 15 mA/cm, a plating time was set to 15 minutes, and a thickness of the formed copper film was 3 to 4 μm.

Comparative Example

Processes and conditions for electric plating were the same as described above in the example, except that a metal powder with a particle structure was added to an electrolyte solution. That is, the electrolyte solution was a pure plating solution to which a metal powder with a particle structure was not added, and a copper film was formed by performing electric plating in the pure plating solution.

The copper films formed in the example and the comparative example were compared. First, a weight of the obtained copper film was measured, and thicknesses of the copper films were compared using copper densities in the copper films. In addition, to evaluate electrical properties, a sheet resistance was measured using a sheet resistance measurer (4 point probe). Moreover, a specific resistance was measured using the measured thickness and sheet resistance, and the electrical characteristics of the copper films formed in the example and the comparative example were analyzed.

Figure 4:
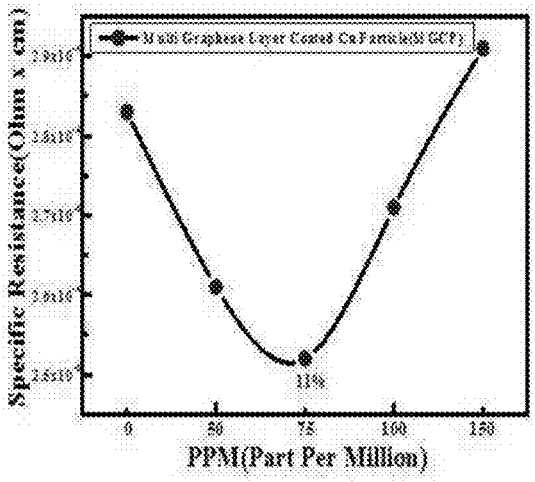
FIG. 4 is a graph showing a specific resistance according to a content of a multi-layer graphene-coated metal powder with a particle structure.

FIG. 4 is a graph showing a specific resistance according to a content of a multi-layer graphene metal powder with a particle structure.

Referring to FIG. 4, to detect an optimal content of multi-layer graphene metal particles, a test for evaluating the optimal content by adding the multi-layer graphene metal powder with a particle structure at an amount of 0, 50, 75, 100 and 150 PPM was executed. As shown in FIG. 4, it was confirmed that a specific resistance when the multi-layer graphene metal powder with a particle structure was added was lower than that when the multi-layer graphene metal powder with a particle structure was not added. Actually, it was confirmed that the specific resistance when the content of the multi-layer graphene metal powder with a particle structure was 75 PPM was approximately 11% lower than that when the multi-layer graphene metal powder with a particle structure was not added. As the specific resistance was lower, electric conductivity increased, and electrical characteristics were improved. According to the test, it was confirmed that the electrical properties when the multi-layer graphene metal powder with the particle structure was added at 50 to 100 PPM were improved, compared to those when the multi-layer graphene metal powder with a particle structure was not added.

Figure 5:
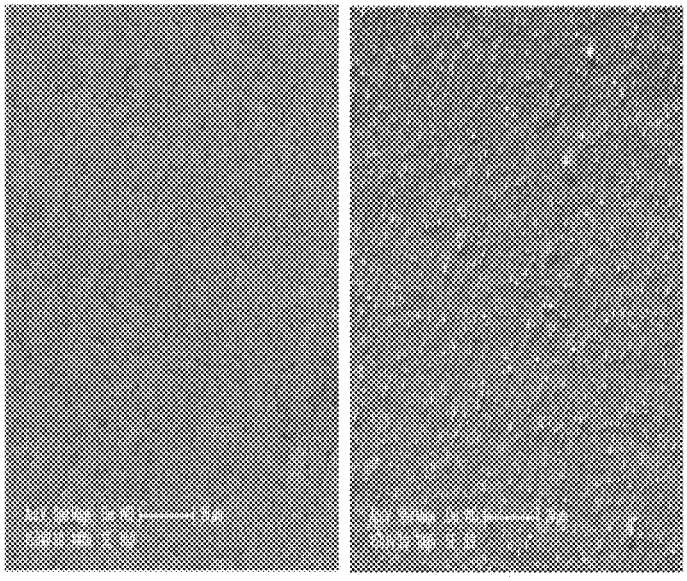
FIG. 5 shows images obtained by optically analyzing surfaces of copper films according to an example and a comparative example.

FIG. 5 shows images obtained by optically analyzing surfaces of the copper films of the example and the comparative example.

Referring to FIG. 5, the image on the left shows a surface of the copper film of the comparative example formed in the plating solution to which the multi-layer graphene-coated metal powder with a particle structure was not added, and the image on the right shows a surface of the copper film of the example formed in the plating solution to which the multi-layer graphene metal powder with a particle structure was added. As shown in the optical images of FIG. 5, compared to the thin film surface of the comparative example, the thin film surface of the example seems to be coated with particles. That is, in the example, it can be confirmed that the surface of the copper film was coated with the multi-layer graphene-coated metal powder with a particle structure, and thus the specific resistance of the thin film was reduced, and the electrical properties were improved.

According to the test results of the present invention, it can be confirmed that the electrical properties are improved when the plating film is formed through plating by adding the multi-layer graphene metal powder with a particle structure to the plating solution. The plating film of the present invention may be applied to a metal interconnection process diode which can maintain electrical properties even when an interconnection width of the diode is reduced in a semiconductor process. In addition, it is determined that, when used as a film for blocking electromagnetic waves and for a solar cell, the plating film of the present invention has an excellent effect.

According to the present invention, a method of forming a plating film by adding a powder having a multi-layer graphene-coated metal particle structure to a plating solution through electric explosion can be provided, and thereby a plating film having improved electrical properties can be formed.

Particularly, a metal interconnection of the plating film formed according to the present invention has a smaller size and width, and electrical properties are improved.

In addition, the plating film formed by the method described in the present invention can be used as a film for blocking electromagnetic waves or a plating film for a solar cell.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of forming a complex plating film on a surface of a base material, the method comprising:

adding multi-layer graphene-coated metal powders to a plating solution; and forming a plating film on the surface of the base material by performing electric plating in the plating solution, wherein the multi-layer graphene-coated metal powders are dispersed in the plating film.

2. The method of claim 1, wherein the multi-layer graphene-coated metal powders are prepared through electric explosion.

3. The method of claim 2, wherein the multi-layer graphene-coated metal powders are formed by coating a metal wire with a carbon-based material, and performing electric explosion of the carbon-based-material-coated metal wire in a solution or in air, and the carbon-based material comprises graphene or graphite.

4. The method of claim 3, wherein the metal wire comprises any one or any combination of any two or more of copper, nickel, aluminum, iron, gold, and silver.

5. The method of claim 3, wherein each of the multi-layer graphene-coated metal powders comprises a metal core and a multi-layer graphene coating, which comprises 1 to 20 carbon atom layers, on a surface of the metal core.

6. The method of claim 3, wherein the coating of the metal wire with the carbon-based material comprises synthesizing the graphene on a surface of the metal wire or transferring the graphene synthesized on a substrate onto the surface of the metal wire.

7. The method of claim 3, wherein the multi-layer graphene-coated metal powders are formed by the electric explosion of the metal wire in the solution, comprising at least one selected from the group consisting of isopropyl alcohol, acetone, ethanol, methanol, carbon compound solvents, glycols including carbon, glycerin, triethanolamine, methylene chloride, deionized water, distilled water, hydrogen peroxide and a metal compound solvent.

8. The method of claim 3, wherein the multi-layer graphene-coated metal powders are formed by the electric explosion of the metal wire in the air comprising a hydrocarbon gas which comprises at least one selected from the group consisting of methane, ethane, propane, butane, acetylene, cyclopentane and cyclohexane.

9. The method of claim 1, wherein the plating solution comprises at least one selected from the group consisting of anhydrous copper sulfate, sulfuric acid and hydrochloric acid.

10. The method of claim 9, wherein the plating solution further comprises an additive.

11. The method of claim 10, wherein the additive comprises at least one selected from the group consisting of an accelerator, a leveling agent and a brightener.

12. The method of claim 1, wherein a concentration of the multi-layer graphene-coated metal powders in the plating solution is 1 to 10000 part per million (PPM).

13. A complex plating film, comprising:

a plating film coated on a surface of a base material, the plating film comprising a first metal; and multi-layer graphene-coated metal powders dispersed in the plating film, each of the multi-layer graphene-coated metal powders comprising a second metal.

14. The film of claim 13, wherein the first metal comprises any one or any combination of any two or more of copper, nickel, aluminum, iron, gold, and silver, and the second metal comprises any one or any combination of any two or more of copper, nickel, aluminum, iron, gold, and silver.

15. The film of claim 14, wherein the plating film comprises thickness of 2 to 50 μm.

* * * * *